United States Patent [19]

Morin et al.

[11] 4,455,952

[45] Jun. 26, 1984

[54] AUTOMATIC SEWING MACHINE

[75] Inventors: Pierre Morin, Soisy-sours-Montmorency; Christian Thirion, Pont-Sainte-Maxence, both of France

[73] Assignee: USM Corporation, Farmington, Conn.

[21] Appl. No.: 520,732

[22] Filed: Aug. 5, 1983

[30] Foreign Application Priority Data

Aug. 13, 1982 [FR] France ..... 82 14106

[51] Int. Cl.[3] ..... D05B 21/00

[52] U.S. Cl. ..... 112/121.12; 112/121.15; 112/102

[58] Field of Search ..... 112/121.15, 121.12, 112/121.11, 102, 2, 303, 308

[56] References Cited

U.S. PATENT DOCUMENTS

| | | | |
|---|---|---|---|
| 688,961 | 7/1901 | McDonald | 112/121.12 |
| 795,150 | 7/1905 | Miller | 112/121.12 |
| 3,710,741 | 1/1973 | McFalls | 112/121.15 |
| 3,988,993 | 11/1976 | Brophy | 112/121.12 |
| 4,171,671 | 10/1979 | Dorosz et al. | 112/121.15 |
| 4,171,672 | 10/1979 | Welcher et al. | 112/121.12 |

*Primary Examiner*—H. Hampton Hunter

*Attorney, Agent, or Firm*—William F. White

[57] ABSTRACT

In a computer-controlled sewing machine for performing a joining operation, e.g. on shoe uppers, a workpiece holder comprises three clamp members one of which is fixed, defining a reference plane, and the others are movable. Two members are provided with workpiece component locating means for locating components in relation to one another and to the sewing instrumentalities of the machine. In use, a first component is located on the first member and is then clamped between the second and third members and, with the first member retracted, a second component is located by the second, fixed, member and then clamped by the first and third members. This facilitates work-handling and improved output of the machine. For selecting a desired sewing pattern, sensing means is provided which detects the particular workpiece components clamped and signals the computer control means of the machine accordingly.

14 Claims, 19 Drawing Figures

AUTOMATIC SEWING MACHINE

BACKGROUND OF THE INVENTION

The present invention relates to an automatic sewing machine for joining elements of a workpiece clamped within a work clamp. The automatic sewing machine comprises a reciprocating needle which penetrates the work clamp containing a workpiece consisting of several components. The components of the workpiece are arranged in overlapping relationship, so as to allow for a join and sew operation. The sewing machine also contains a control which effects a relative displacement of support for the work clamp and sewing instrumentalities in such a manner that a joining operation may be executed progressively along the desired path on the workpiece clamped by the work clamp. The work clamp comprises three elements one of which is fixed on the support. The other two elements are movable relative to the fixed element. The arrangement of elements being such that, when the elements are closed, the components of a workpiece are clamped adjacent in such a manner that a join and sew operation can be effected.

U.S. Pat. No. 4,171,672 describes such a machine. In this machine, the work clamp requires the operator to first position the two components of the workpiece relative to each other this positioning usually relies on previously applied stitch markings on at least one of the two components, it presents the thus positioned components to the work clamp, while holding both of them in position one with the other. The handling of the workpieces in this manner is not reliable, however, because the shape of the elements of the work clamp tends to render difficult the presentation of the located components of the workpiece, so that the relative location of the workpieces is uncertain. Furthermore, when the operator relies on stitch markings, the latter are covered by the element located along the marking so that the operator cannot readily verify that the positioning has been maintained and furthermore, when presented to the clamping elements, the latter themselves cover the workpiece component carrying the stitch markings, in the vicinity thereof, so that the operator cannot be sure that the components of the workpiece are properly located with respect to the clamping elements. In the aforementioned document, different types of clamp elements are described and are intended to remedy the disadvantages which arise by the clamping elements obscuring the stitch markings, but, in many cases, the use of the clamping elements of that machine renders the handling of workpieces difficult. Clearly, if the workpiece components are not properly positioned in relation to one another, the finished workpiece may be less than satisfactory.

SUMMARY OF THE INVENTION

The invention relates to an automatic stitching machine having an improved work clamp of the aforementioned type, in which the components of the workpiece are positioned in the region of overlap in relation to the work clamp itself and are clamped when they have been thus positioned, independently of other workpiece components, so that the accuracy of the relative overlap of the components is determined by the work clamp and does not depend upon the dexterity of the operator.

This invention allows this feature to be obtained, because a first and a second of three elements of the work clamp define first and second abutments enabling a first and a second workpiece component to be respectively positioned in an overlapped manner. The second and the third elements of the work clamp furthermore clamp the first workpiece component when it is positioned by the first abutments, and the second and third elements of the work clamp are intended to clamp the second workpiece component when it is positioned by the second abutments, by closure of the movable elements against the fixed element.

It is thus to be noted that, by using the machine in accordance with the invention, although the work clamp has a simple construction and a small number of elements, this work clamp can nevertheless be utilized for positioning each workpiece component independently of another component, in relation to the work clamp itself and thus in relation to the stitching instrumentalities, without the operator having to rely upon stitch markings or other visual aids. Thus, the invention allows the workpiece to be assembled with increased accuracy and fixed tolerances, the loading of the workpiece components being facilitated, so that the output of the machine is increased while the role of the operator is rendered simpler. Furthermore, the operation of stitch marking is eliminated.

By the use of a work clamp in accordance with the invention, the operator can position each component against the corresponding abutments, then close the movable elements of the work clamp against the fixed element, the movable elements thus being controlled so that they are closed as aforesaid by a single motor. However, the movable elements of the work clamp are preferably controlled independently of one another, two separate motors being utilized. In this way, a first workpiece component can be positioned and clamped between the second and third elements of the work clamp, the relative movement of separation then taking place between the first element and the other two elements of the work clamp so that the second workpiece component can be introduced and positioned, the second workpiece component then being clamped by the first element of the work clamp.

The motors of the movable elements, which can advantageously be pneumatically controlled, may be double acting, that is to say they can move the movable elements of the work clamps so that they approach or move away from the fixed element. However, at least one of the movable elements, and preferably both, are resiliently urged towards the fixed element. In this way, when a workpiece component has to be introduced, the operator urges the appropriate movable element of the work clamp, or both of them, away from the fixed element, the element(s) thus move returning towards the fixed element when they are freed by the operator after the workpiece component has been positioned as aforesaid.

The one of the three elements of the work clamp which is fixed, having a workpiece-engaging surface which constitutes a reference plane in which the workpiece is thus supported before being operated upon, may be constituted by the third element, that is to say the element which does not have any abutment. In this case, the first element of the work clamp is movable relative to the fixed element and can be moved downwardly away therefrom while the second element of the work clamp is supported so that it can move upwardly in moving away from the fixed element. In this case, and when in operation, the first element of the work clamp is first positioned in the reference plane and a first workpiece component is positioned by the first element of the work clamp, and the second element of the work clamp is lowered in so that it clamps the workpiece component against the third element of the work clamp. Then, the first element of the work clamp is lowered relative to the second and third elements so that it enables the second workpiece component to be introduced and positioned by the second abutments of the second element of the work clamp, and the first element of the work clamp is brought back into the reference plane so that it clamps the second workpiece component in position.

In a modification, and preferably, however, the fixed element of the work clamp is constituted by the first or the second element. More precisely, in one advantageous embodiment of the machine, the fixed element of the work clamp is constituted by the second element, the first and third elements of the work clamp being able to be lowered away from the fixed element. In operation using such an arrangement, a first workpiece component is first positioned by the first abutments, the first and third elements of the work clamp being then raised so as to clamp the first workpiece component against the second element of the work clamp, and the first element of the work clamp is then lowered so as to move away from the second element of the work clamp and enable the second workpiece component to be introduced and positioned by the second abutments, the first element of the work clamp then returning to effect clamping, so that the second workpiece component is clamped against the second element of the work clamp.

It should be be noted that, when using a work clamp as described above, the workpiece components may easily be manipulated, positioned and clamped in a minimal time by the operator, and the pieces are nevertheless precisely positioned with reliability.

In the machine described in the description of the aforementioned U.S. Pat. No. 4,171,672, the elements of the work clamp may form a first or a second arrangement. When they form a first arrangement, a first type of workpiece can be clamped thereby so that a first join and sew operation can be effected, while, in the case of the second arrangement, a second type of workpiece may thus be clamped with a view to a second join and sew operation. The support for the workpiece holder can support the elements of the holder according to the one or other arrangement. Such a workpiece holder is particularly useful when the two joining operations are to be effected along paths which are located symmetrically, so that the same abutments can be used for the two operations, although the arrangement of the elements of the work clamp may be modified, for example by reversing them.

The use of a work clamp of this type may, however, show itself disadvantageous when two joining operations are to be effected on the same workpiece components. For example, in the course of the manufacture of shoes, it may be desirable that the quarters are joined to a vamp and, with the aid of the machine described in the aforementioned patent, it was not considered efficient to finish each shoe upper before passing to the next, because this arrangement would necessitate re-arranging the elements of the work clamp for each operation on the contrary, the current practice is to carry out a first joining of all the workpiece components of one batch, then re-arrange the elements of the work clamp and carry out the second operation. Even in this way, changing the elements of the work clamp can be considered time-consuming and tedious.

In accordance with the invention, the first and second abutments of the work clamp comprise preferably first and second portions which allow different components or different parts of the workpiece components to be positioned relative to one another.

Because of this arrangement of abutments having first and second locating parts, the operator, when utilizing the machine in accordance with the invention, can carry out two joining operations successively without modifying the arrangement of the elements of the work clamp. Thus, each workpiece can be finished before passing to the next, without any loss of time. Furthermore, because of this arrangement of different abutments for the different operations, if desired it is no longer necessary that the two operations be symmetrical. This feature can be advantageous even in the case of the manufacture of shoes, because it may be desirable that different joining operations be executed on the opposite sides of the shoe upper.

Other features of the machine described in the aforementioned patent are also described in U.S. Pat. No. 4,171,671. Such another feature described in this latter patent is constituted by a device, mounted on the work clamp support, for detecting if the elements of the work clamp are in their first or second arrangement. In this particular embodiment described, the two arrangements are achieved by reversing the various elements and re-introducing them in the support. The detector device, which is constituted by a switch, is thus controlled by a shoulder formed on one face of one of the elements of the work clamp, the arrangement being such that the switch is controlled by the shoulder when it engages it, but does not remain controlled when the shoulder when the shoulder is at the other side of the element of the work clamp. The detecting device is arranged to transmit a signal to the control means of the machine and, following such signal, a different stitch (join) pattern is automatically prepared so that it may be utilized in the course of the joining operation to be carried out.

In the same way, in the machine in accordance with the invention, a detecting device is advantageously erased such that it detects whether the workpiece components positioned by the first or second parts of the abutments are clamped by the elements of the work clamp. More precisely, the elements of the work clamp advantageously have a shape such that they form a first region having an opening, closed by one part of a workpiece component positioned by a first part of the abutments, and a second region having an opening which is closed by a part of a workpiece component positioned by a second part of the abutments, the detecting device comprising two sensors associated each with one of the regions and in one opening, for detecting the moment when the region associated therewith is closed as aforesaid.

In this manner, a suitable joining pattern can be prepared so that it may be used by the control means as a function of a switch provided by one or other of the sensors, which function according to the operation which is to be performed.

When the workpiece which is to be operated upon is a shoe upper as indicated above, in using the machine in accordance with the invention, the first and second abutments preferably ensure that the ramp is positioned in the region of its tongue and the quarters along the side seam region, the first and second parts of the abutments being adapted to the shape of the opposite sides of the shoe. As indicated above, the first and second parts of the abutments may be symmetrical or not, according to the operations to be carried out and the configuration of the workpiece components in the region of the seams to be formed in the joining operation.

As in the case of the machine described in the aforementioned U.S. Pat. No. 4,171,671, the control means of the machine in accordance with the invention may comprise a computer, the join patterns being stored in memory in the computer in the form of digitized coordinate axis values. When the first and second parts of the abutments are symmetrical, furthermore, as indicated in the aforementioned patent, the Y axis direction may be simply inverted while the displacement along the X axis is maintained. In one modification, when the first and second parts of the abutments are not symmetrical, two separate patterns may be necessary and they are stored separately in the memory.

BRIEF DESCRIPTION OF THE DRAWINGS

This invention will be described in greater detail with reference to the attached drawings by way of non-limiting examples, and in which.

DESCRIPTION OF THE PREFERRED EMBODIMENT

Figure 1:
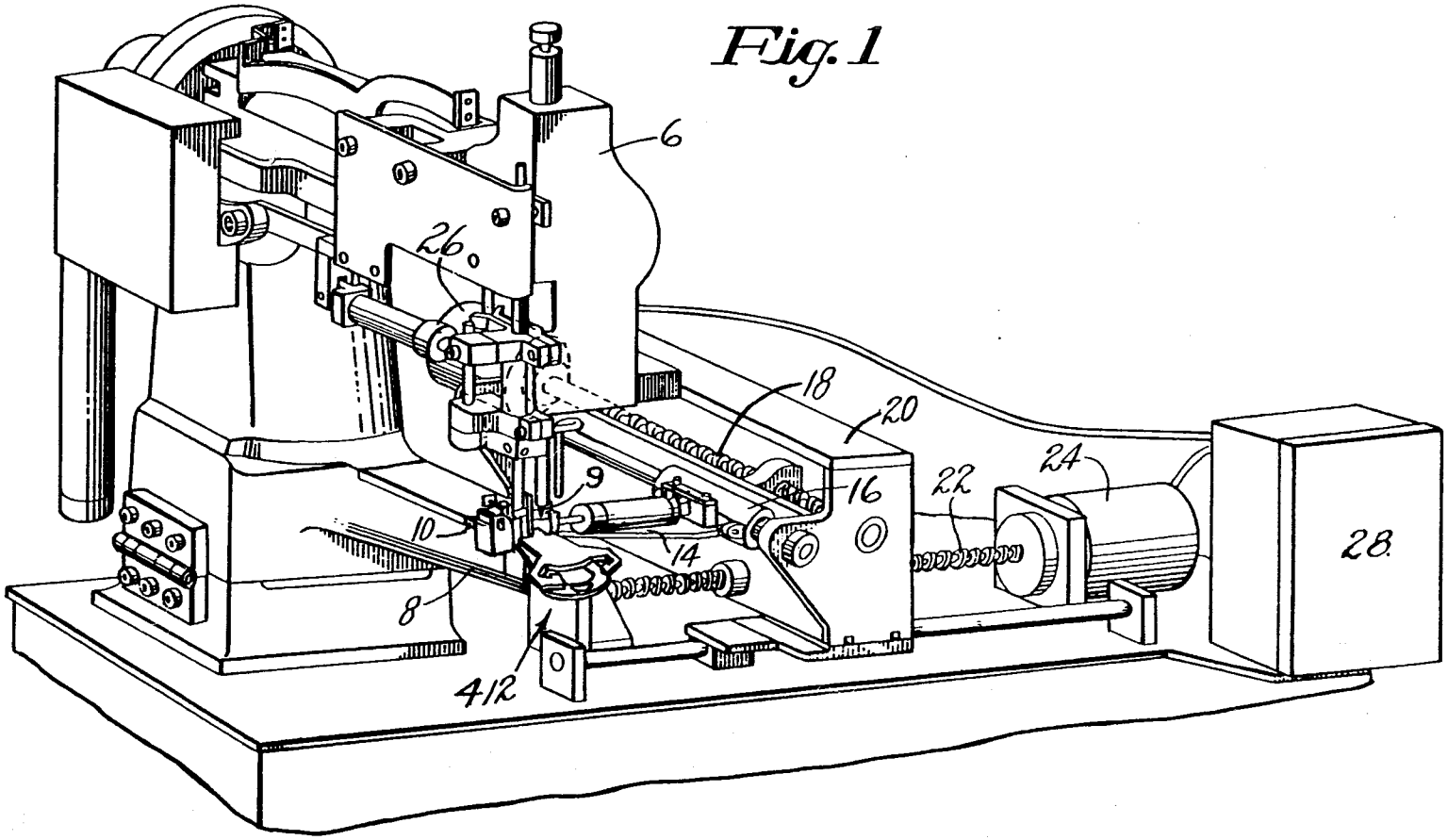
FIG. 1 shows in perspective a sewing machine in accordance with the invention.

The machine shown in the drawings is an automatic sewing machine and is generally similar, except for the features described below in this specification, to the machine of the aforementioned U.S. Pat. No. 4,171,671. Thus, the machine comprises a sewing head 6, including a reciprocating needle 9, and a sewing table constituted by an arm 8 (FIG. 1) on which rests a mechanism for displacing a carriage 10 for receiving a workpiece loading and clamping device having the general reference 412, and which can be displaced relative to the sewing head 6 in order to cause it to operate on a workpiece to form a seam having a predetermined shape or trace.

The carriage 10 comprises an arm 14 which is connected with a sleeve 16 which is moved to and fro and inversely along a support shaft 17 by means of a rack-and-pinion transmission 18 mounted on a movable platform 20. A further rack-and-pinion transmission 22 moves the platform 20 together with the carriage 10 laterally. The axis of this latter lateral displacement is referred to as the "X axis" below in this specification, while the axis corresponding to the movement of the carriage caused by the transmission 18 is referred to as the "Y axis".

For moving the carriage 10, the machine comprises two servo motors 24 and 26 which, co-operating each with one of the transmissions 22 and 18, determining the amount of movement along the X and Y axis. A numerical control 28, as a function of a program or of a series of stored data, controls the function of these servo motors 24 and 26 in such a manner as to produce a seam following a particular trace. To do this, said control creates and supplies to each motor a series of impulses which correspond to the desired amount of movement along the X and Y axis.

Figure 2A:
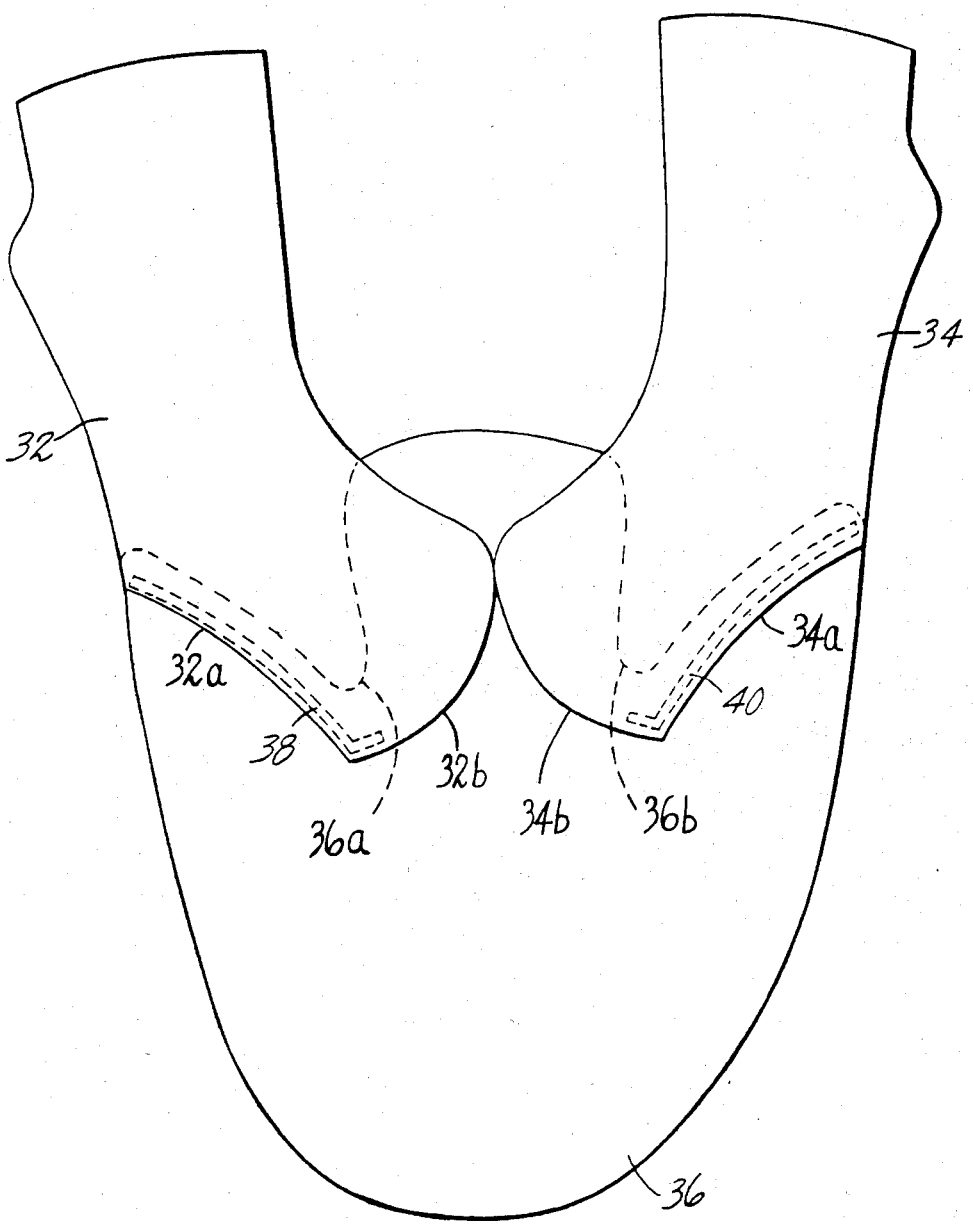
FIG. 2A shows in plan a workpiece on which the stitch markings are symmetrical.

FIG. 2A shows, by way of example, two components constituting a workpiece which the machine is to stitch. In this instance the workpiece comprises a shoe upper two quarters 32 and 34 of which are to be stitched to a vamp 36. The necessary stitch traces in each case carry the references 38 and 40. It is evident in this case that these two traces 38 and 40, which extend in opposite directions, are symmetrical, the first 38 being considered as a "normal trace" and the other 40 as the "opposite trace".

Figure 2B:
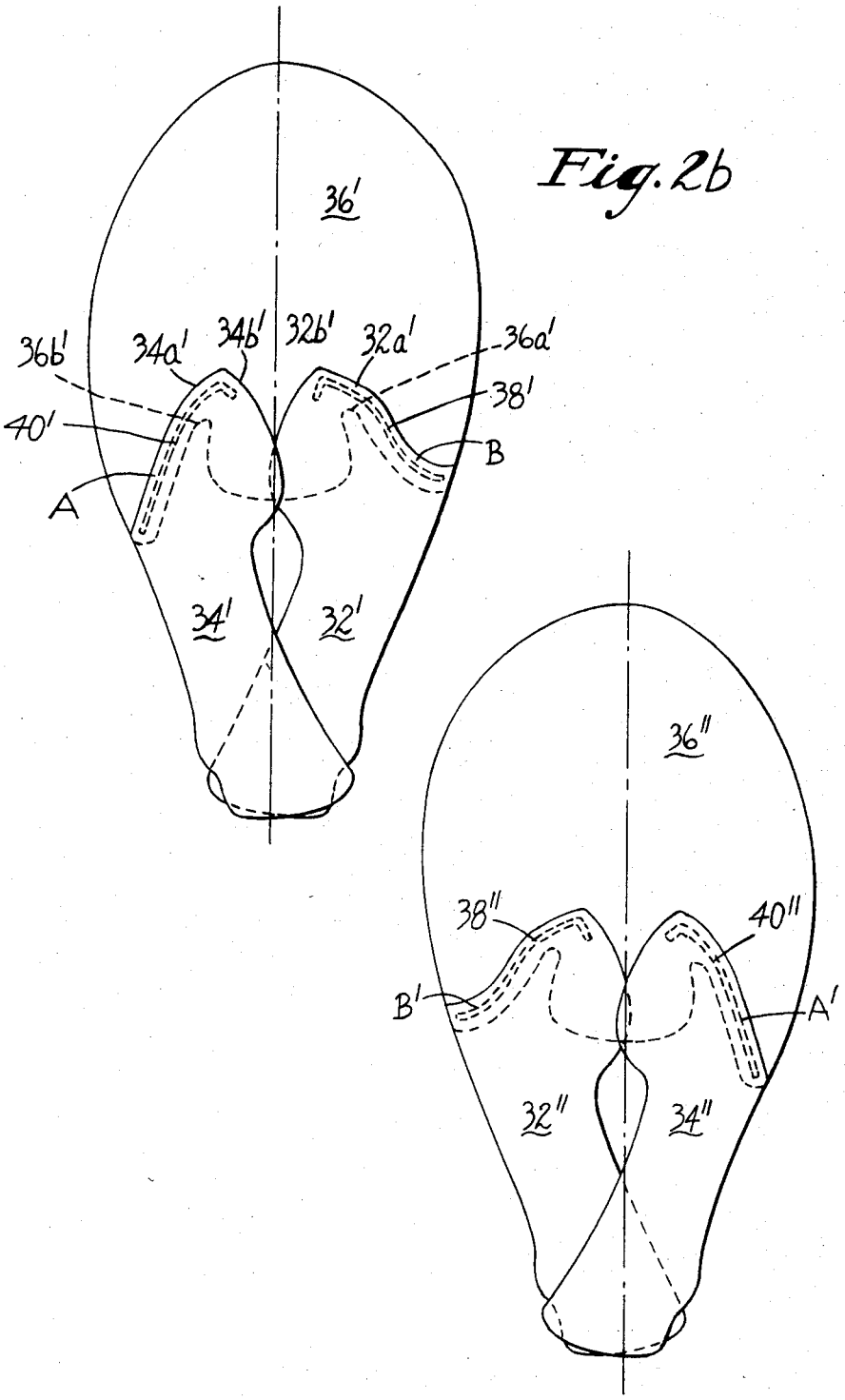
FIG. 2B shows in plan two workpieces on which the stitch markings are not symmetrical.

FIG. 2B shows the components of a pair of workpieces which the machine is to stitch. The components of one of the uppers of the pair are a quarter 32' which is to be stitched on the vamp 36' following a first trace 38', another of these components being a quarter 34' which is to be stitched on the same vamp 36' following a second trace 40'. The components of the other upper of the pair are a quarter 32" which is to be stitched on a vamp 36" following a trace 38", another of these components being a quarter 34" which is to be stitched on said vamp 36" following a trace 40". In this pair of workpieces, the two traces 38' and 40' applied to the vamp 36' are not symmetrical. The two traces 38" and 40" applied on the vamp 36" also are not symmetrical, but on the pair of workpieces, the traces 38' and 38" are symmetrical, as are also the traces 40' and 40". Moreover, in certain conditions, one could have four different asymmetric traces controlled by the detection system as a function of the quarter (32', 32", 34', 34") to be stitched on the vamp (36', 36").

Figure 3A:
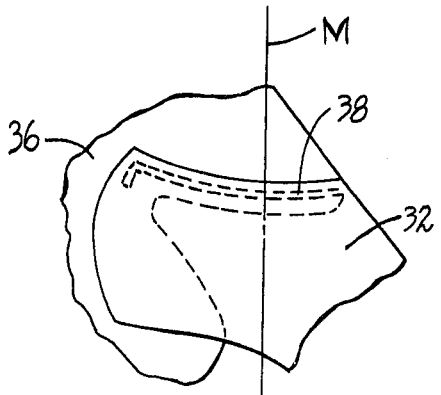
FIG. 3A shows in plan part of the workpiece of FIG. 2A, showing one of the markings located with reference to a longitudinal axis of the machine.
Figure 3B:
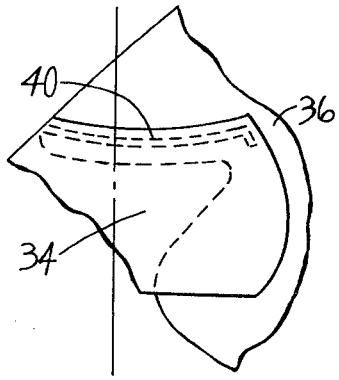
FIG. 3B shows in plan a part of the workpiece of FIG. 2A, showing the other marking located with reference to the same axis as in the case of FIG. 3A.

For the workpiece shown in FIG. 2A, the traces 38 and 40 of which are symmetrical, it is proposed to consider the traces according to another axis of symmetry M located longitudinally with respect to the machine and allowing both the quarter 32 and vamp 36 and also the quarter 34 and vamp 36 to be presented to the loading device 412 without reversing these elements. FIGS. 3A and 3B show respectively the traces 38 and 40 with respect to the axis of symmetry M. In the example in question, the traces have an identical part between the "normal trace" and its "opposite trace", which allow the traces to be positioned at opposite sides of the axis M, which is often the case and affords additional advantages so far as concerns the bulkiness of the device, the relative movements between the machine and the device for carrying out the two traces, the clamping pressure, etc.

Figure 3C:
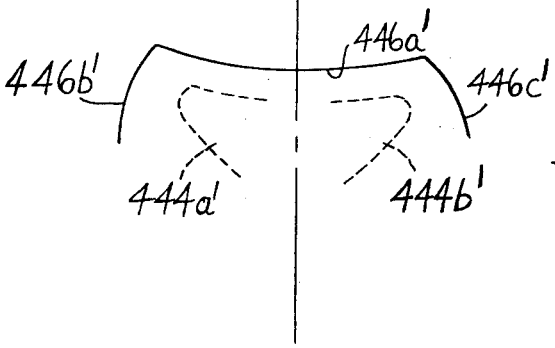
FIG. 3C shows a compromised shape relating to the edges of the parts of the workpiece, which can serve as a reference in relation to the axis of FIG. 3A.
Figure 4:
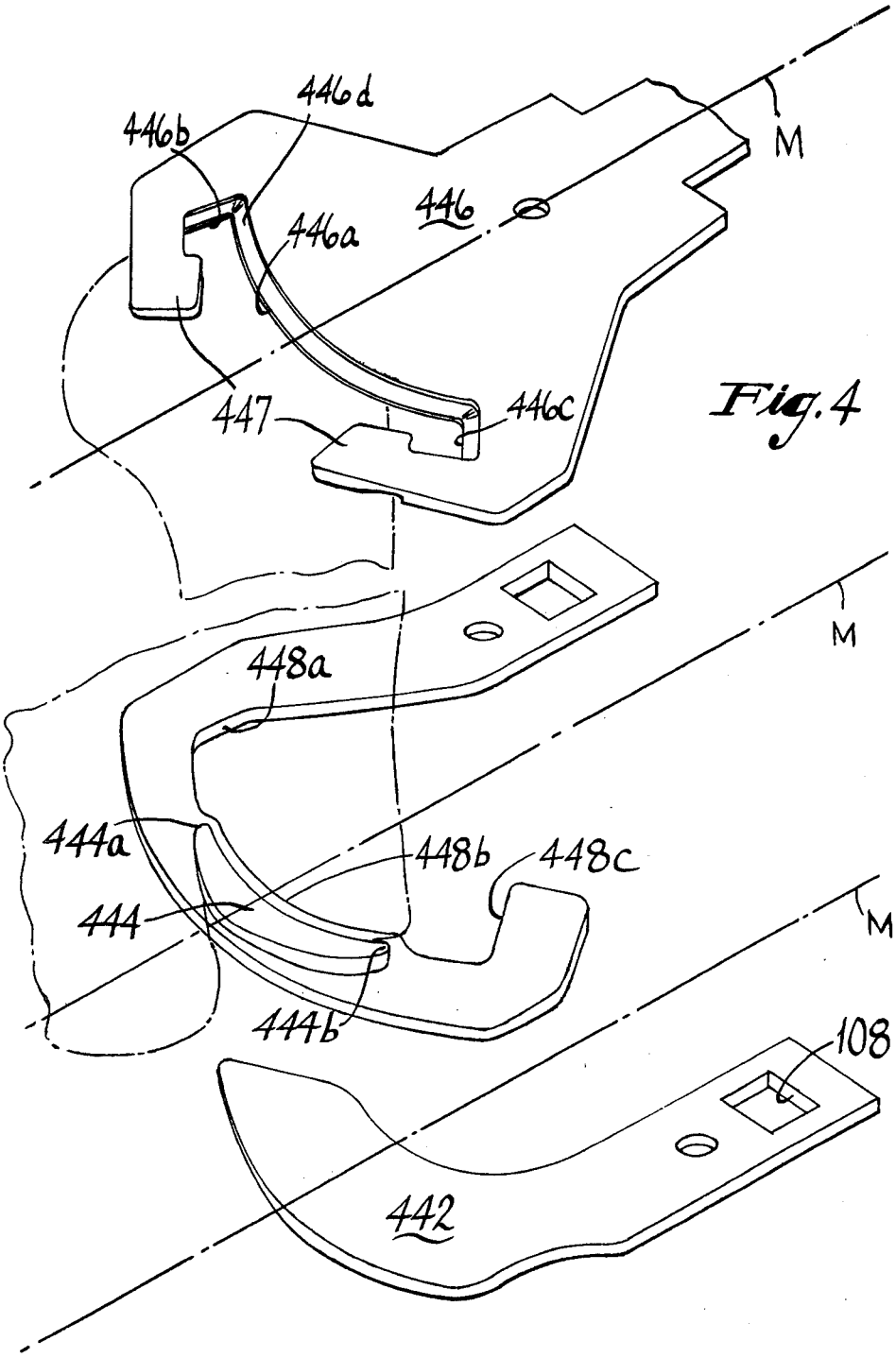
FIG. 4 shows in perspective the three elements of the loading device of the machine in accordance with the invention, each in relation to the axis of FIG. 3A and aligned one above the other.

The loading and clamping device 412 comprises three elements 442, 446, 448. FIG. 4 showns the three elements in exploded perspective, each element being placed with respect to the axis M of FIGS. 3A to 3C and in the position of clamping the workpiece; the latter is shown partially in chain-dot line, so far as concerns the vamp 36 with regard to an abutment 444 (constituting a first locating means provided on the first element 448 of the device) and the quarter 32 with respect to first and second abutments 446*a* and 446*b* of the element 446 (constituting a second locating means provided on the second element 446 of the device 412). The second element 446 is shown with an under-cut 446*d* above its abutments in order to avoid, in the case of the machine used in the description, any possibility of contact of the presser foot of the machine with the element 446. FIG. 3C is obtained from FIGS. 3A and 3B, utilizing the edges of the parts of the workpiece for defining the stitching area and for determining the location of the abutments. The abutments 444*a*' and 44*b*' shown in dotted line, correspond to the edge of the vamp 36 in the regions 36*a* and 36*b* of FIG. 2A. The abutments 446*a*' and 446*b*' shown in full line correspond to the edges of the quarter 32 in the regions 32*a* and 32*b*. The abutments 446*a*' and 446*c*' correspond to the edges of the quarter 34 in the regions 34*a* and 34*b* respectively. The element 448 defines with the element 446 the stitching area of the two traces 38, 40 between its edges 448*a*, 448*b* and 448*c* and the edges of the abutments of the element 446 and its two clamping fingers 447. The element 442 is disposed beneath the element 446 with a profile similar to the abutment 446*a* and preferably slightly set back, in order to facilitate the loading of the quarter against the abutments of the element 446 as described in greater detail below in the present specification.

Figure 5:
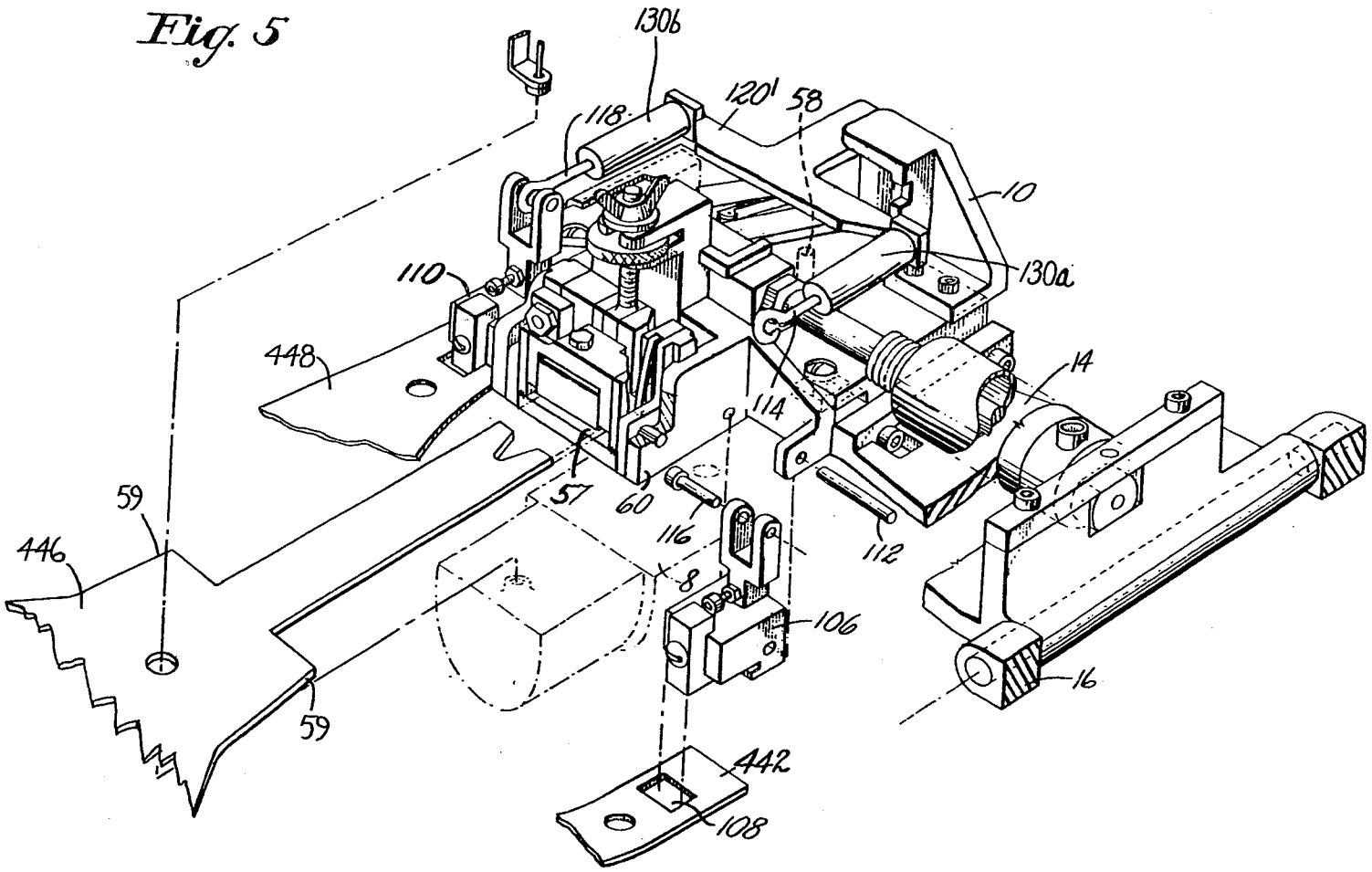
FIG. 5 shows the machine in accordance with the invention in which the device of FIG. 4 is incorporated.
Figure 6A:
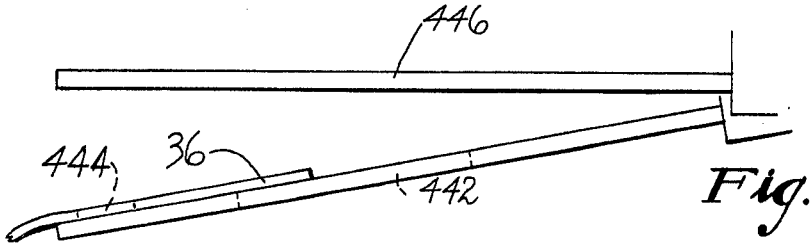
FIGS. 6 to 6E are diagrams showing the function of the device of FIG. 4.
FIGS. 6F to 6I are diagrams showing the function of a modification of the device of FIG. 4.
Figure 6B:
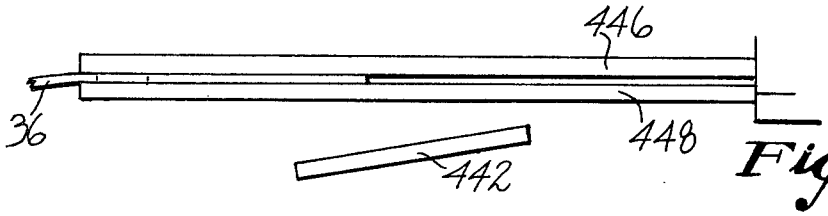
Figure 6C:
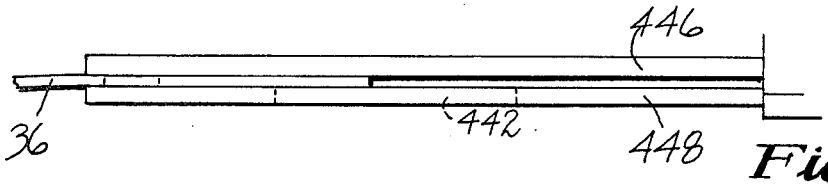
Figure 6D:
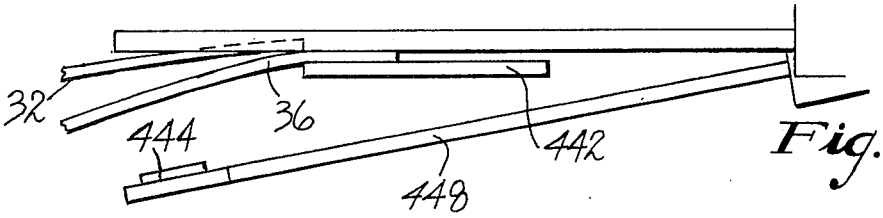
Figure 6E:
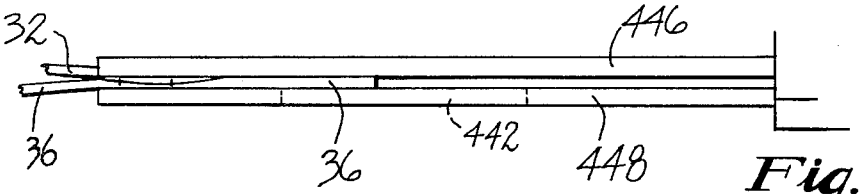
Figure 6F:
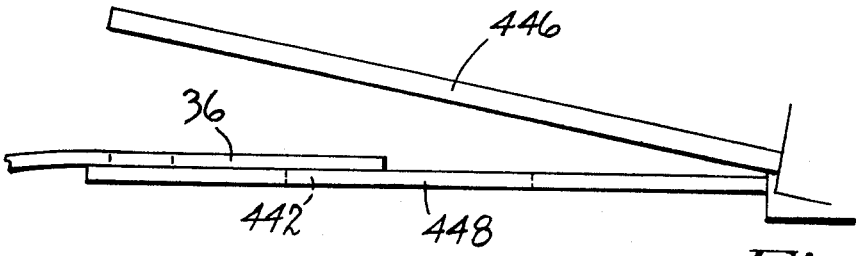
Figure 6G:
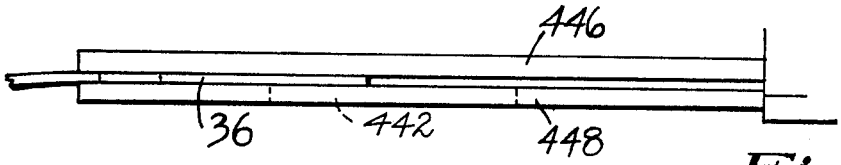
Figure 6H:
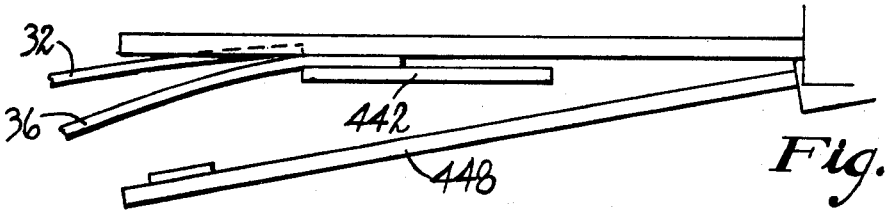
Figure 6I:
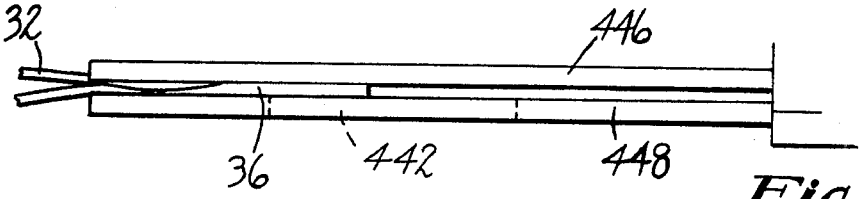

FIG. 5 illustrates that the various elements of the device 412 are introduced into the carriage 10. It is in fact necessary to insert the second element 446 into an opening 57 provided in the front face of this carriage 10 until its U-section end notch straddles a register pin 58 which, situated at the rear of carriage 10, ensures that said element is correctly located laterally. This element 446 is inserted a little further until its shoulders 59 engage with the side edges of the opening 57. The mechanism 60 (described in detail in the aforementioned U.S. Pat. No. 4,171,672) then holds this element 446 fixed.

In FIG. 5 it is noted that the third element 442 of the device 412 is connected to a pivoting member 106, the forward edge thereof co-operating with a lower groove of the latter member 106. The element is maintained thus in place by fitting a lower projection of this pivoting member 106 in a rectangular slot 108 formed in the element 442. The first element 446 of the device 412 is likewise connected to a pivoting member 110. The member 106 pivots relative to the carriage 10 about a cylindrical axis 112 and the other pivoting member 110 is mounted in the same manner. Furthermore, the member 106 is connected to a piston rod 114 of a pneumatic jack 130*a*. Similarly, the pivoting member 110 is connected to a piston rod 118 of a pneumatic jack 130*b*. The two pneumatic jacks are mounted on a fixed arm 120 of the carriage 10.

The loading cycle in an operating mode is represented by FIGS. 6A to 6E in which the fixed element 446 serves as a reference plane for the workpiece. The device is shown in section along the axis M of FIG. 4 and in rest position the first movable element 442 is pivoted downwardly relative to the reference plane. The third movable element 448 is also pivoted downwardly in the rest position and in the same plane as the element 442. In a modification (not shown), the element 448 may be held against the fixed element 446 resiliently in order to hold a vamp 36, positioned against one of the abutments 444*a* and 444*b*, against the element 446 while waiting to be clamped by the element 442. In a modification of the operating mode of FIGS. 6F to 6I, it is the element 442 which is fixed and the elements 448 and 446 are movable.

Loading in accordance with the operating mode of FIGS. 6A to 6E is as follows:

- the operator places a vamp 36 on the abutment 444*a*, then effects its transfer into the reference plane against the upper element 446,
- he actuates the element 442, which clamps the vamp 36 against the element 446 in a defined position,
- the element 448 is then lowered to allow the operator to insert the quarter 32 above the vamp 36 and against the abutments 446*a* and 446*b* of the element 446,
- with the quarter 32 in place on the vamp 36, the operator actuates the element 448, which moves again upwardly to clamp the two parts of the workpiece against the plate 446.

The loading of the workpiece in accordance with the modification of the operating mode of FIGS. 6F to 6I is in general identical with that of FIGS. 6A to 6E, but the disposition and function of the loading elements are different: the fixed element is now the third element 442 which determines the reference plane, the first element 446 is movable and is subjected to pressure in order to maintain the vamp 36 against the fixed element 442 once it is placed on the abutment 444*a* of the second element 448 by the operator. With the vamp clamped in defined position by the element 446 against the fixed element 442, the element 448 is lowered in order that the operator can insert the quarter 32 between the element 446 and the vamp 36 in order to place it against the locating abutments 446*a* and 446*b*. The operator actuates the element 448, which moves upwardly again to clamp the two parts of the workpiece against the element 446. It is recommended that a stronger clamping pressure be used for the element 446 than for the element 448.

Figure 7A:
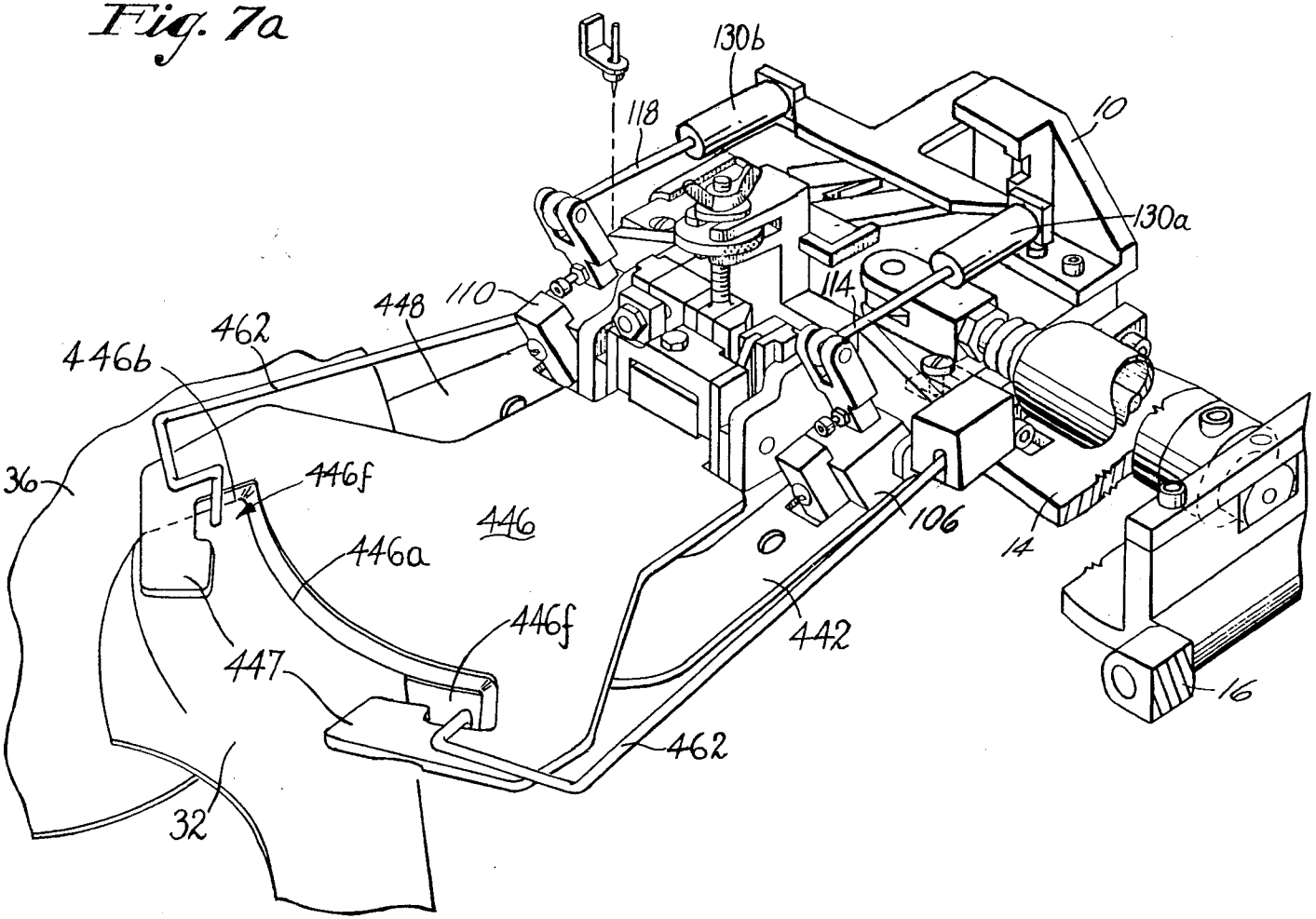
FIG. 7A is a partial perspective view of the machine, showing the device loaded with the workpiece as well as a system for mechanically detecting workpieces.

For carrying out different traces automatically for different workpieces, the machine comprises a detecting means which utilizes a detecting zone lying on the so-called loading, that is to say which determines what part of the device is loaded or not loaded, in order to indicate the appropriate trace to the machine. FIG. 7A shows two sensors 462 which are aligned each with a region 446*f* provided by the elements 446, 448 of the device. One of these regions 446*f* is obstructed (the other remaining open) when the device is loaded with a workpiece for one of the two traces, and the other (the one remaining open) is obstructed when the device is loaded with the workpiece for the other of the traces. When one region is obstructed in this manner, its associated sensor is actuated. The detecting means shown in FIG. 7A is provided for a workpiece the two traces of which are symmetrical (as shown in FIG. 2A).

Figure 7B:
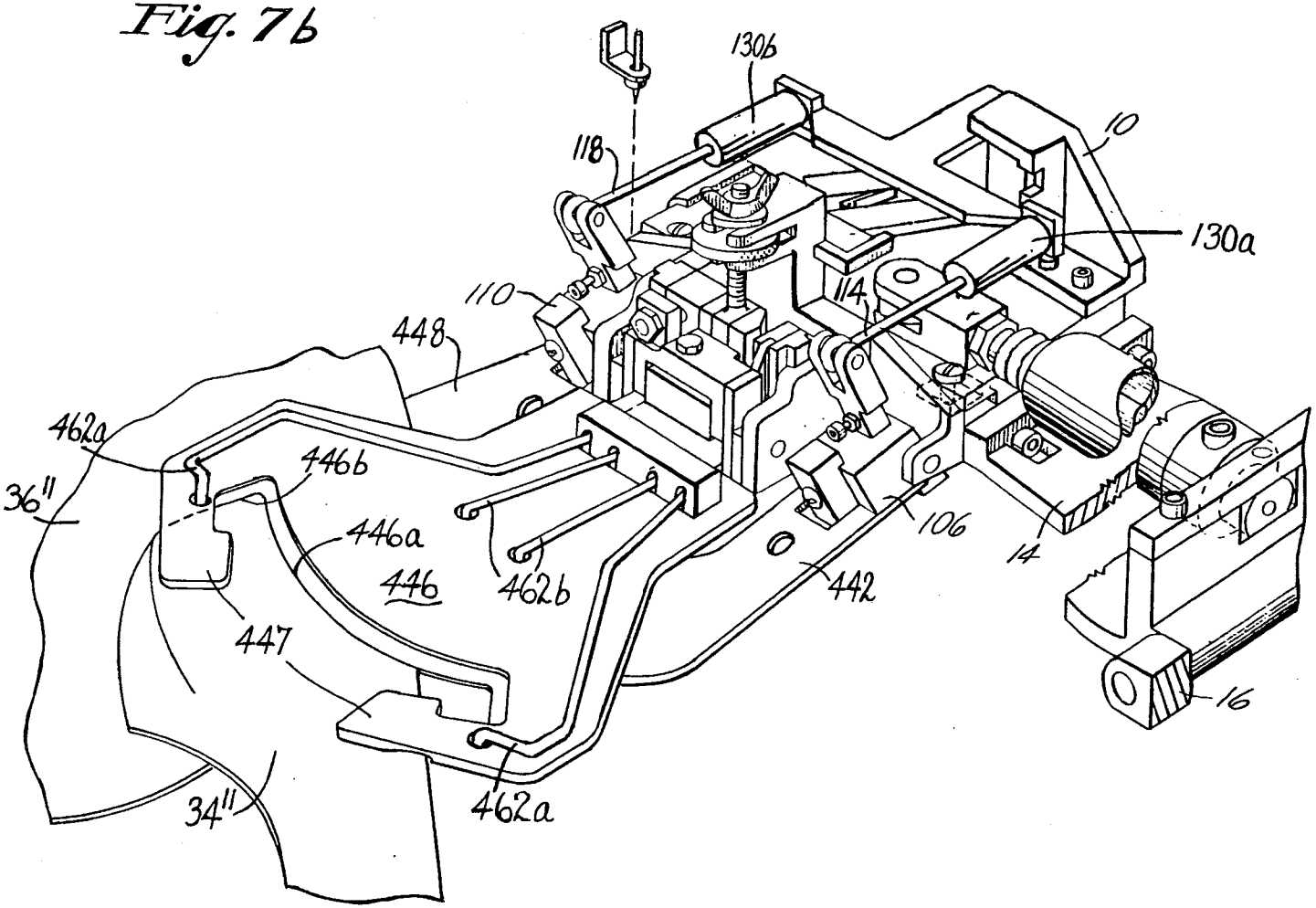
FIG. 7B, which is similar to FIG. 7A, shows another system for detecting the workpieces shown in FIG. 2B.

Although one only of the sensors 462 shown in FIG. 7A is sufficient to determine if the loading is concerned with the quarter 32 or 34, and in order to make a choice between the two different traces, there exists practical reasons for using two sensors, which further enable it to be known whether the machine is loaded or not. Moreover, when the right and left side seams of the same upper are not symmetrical in relation to the center of the upper, there are four different traces, as shown in FIG. 2B, identified as A:A':B:B', for a pair of uppers necessary for a pair of shoes. In addition, the direct loading in accordance with the invention implies that the trace A and the trace B are carried out by loading the device at the same side and the traces A' and B' by loading at the other side of the device, thus enabling two other zones of differentiation to be determined, which can be used by the detecting system to determine the trace which is to be effected by the machine, as a function of the loading effected by the operator without the latter having any need to intervene in the selection. Of course, the so-called detection system may be mechanical, pneumatic, photoelectric, etc. A mechanical solution is provided in FIG. 7B, which shows four sensors 462*a*, 462*b* for the zones of differentiation for the asymmetric uppers of FIG. 2B. As indicated in FIG. 7B, the left-hand sensor 462*a* is actuated, that is to say the sensor for the first zone of differentiation, while the second left-hand sensor 462*b* and the right-hand sensors are not actuated. In this way, the trace controlled by the loading and the detecting device is that which correspond to the stitching of the quarter 34" on the vamp 36". If the two left-hand sensors 462*a*, 462*b* are actuated, the trace is that of the stitching of the quarter 32' on the vamp 36'. If a right-hand sensor is actuated, the quarter 34' is stitched on the vamp 36' and if two right-hand sensors are actuated, the quarter 32" is stitched on the vamp 36". It is thus possible to detect four different loadings and to signal them to the programming means of the automatic sewing machine, without any intervention by the operator other than the so-called loading.

We claim:

1. Automatic sewing machine for joining workpiece components comprising sewing instrumentalities comprising a reciprocating needle, a work clamp supported by a support and allowing a workpiece having several components to be clamped such that the components are positioned in overlapping relationship, and a control means for ensuring the relative displacement of the support for the work clamp and the sewing instrumentalities in such a manner that a joining operation may be effected progressively along a desired path on a workpiece clamped by the work clamp, said work clamp comprising three elements, one element being fixed on the support and the others being movable relative to the fixed element, the arrangement being such that, when the elements of the work clamp are closed, the workpiece components placed therebetween as aforesaid are clamped near the region of overlap between the workpiece components, at opposite sides of the path along which the joining operation is to be effected, the passage of the reciprocating needle being however allowed in this region, the first and second of the three elements having respectively first and second abutments enabling the first and second components of a workpiece respectively to be positioned in overlapping relationship and in that the second and third elements clamp the first workpiece component while it is positioned by the first abutments, and the first and third elements clamp the second workpiece component while it is positioned by the second abutments by closing the movable elements against the fixed element of the work clamp.

2. Machine according to claim 1 characterized in that the movable elements of the work clamp may be controlled independently of one another.

3. Machine according to claim 2 characterized in that at least the one of the movable elements of the work clamp is urged resiliently towards the fixed element.

4. Machine according to claim 2 characterized in that the fixed element of the work clamp is constituted by one of the first and second elements of the work clamp.

5. Machine according to claim 2 in which the work clamp can support a workpiece for a joining operation to be executed on the workpiece along a first path or along a second path, characterized in that the first and second abutments each comprise a first and a second part allowing different workpiece components or different parts of workpiece components to be positioned relative to one another.

6. Machine according to claim 5 characterized in that it comprises a device for detecting the clamping of the workpiece components positioned by the first or second parts of the abutments by the elements of the work clamp.

7. Machine according to claim 6 characterized in that the elements of the work clamp have such a configuration that they form a first region having an opening which is closed by one part of a workpiece component positioned by a first part of the abutments, and a second region having an opening which is closed by a part of a workpiece component positioned by a second part of the abutments, and in that the detecting device comprises two sensors each associated with one apertured region, for detecting when the associated region is closed as aforesaid.

8. Machine according to claim 5 in which the work clamp is for holding a first workpiece component constituted by a shoe vamp and a second workpiece component constituted by the quarters of a shoe upper, in order that these elements are secured together in successive joining operations along two different paths, characterized in that the first and second abutments ensure that the vamp is located adjacent its tongue and the quarters along their side seam region, the first and second parts of the abutments being adapted to the shape of the opposite sides of the shoe.

9. Machine according to claim 5 characterized in that the first and second parts of the abutments are symmetrical.

10. A work clamp for use in an automatic sewing machine, said work clamp being operative to clamp at least two components of a workpiece in an overlapping relationship, said work clamp comprising three elements wherein the first and second of the three elements have respectively first and second abutments enabling a first and a second component of a workpiece to be positioned in overlapping relationship and wherein the second and third elements clamp the first workpiece component against the first abutments and further wherein the first and third elements clamp the second workpiece component against the second abutments.

11. The work clamp of claim 10 wherein the second element is fixed relative to said first and third elements of the work clamp which are mounted within an automatic sewing machine for rotation relative to said second element.

12. The work clamp of claim 10 wherein the first and second abutments each comprise a first and second part allowing different workpiece components or different parts of the workpiece components to be positioned relative to one another.

13. The work clamp of claim 12 wherein the first and second parts of the abutments are symmetrical.

14. The work clamp of claim 10 wherein the first workpiece component comprises a shoe vamp and the second workpiece component comprises a quarter of a shoe upper to be joined to the shoe vamp.

* * * * *